United States Patent [19]

Lind

[11] 4,170,930

[45] Oct. 16, 1979

[54] SCREEN FOR IMPROVING THE ENVIRONMENT OF A WORKPLACE HAVING A PLURALITY OF WORKING AREAS

[76] Inventor: Leif I. Lind, Storsjövägen 7, Johanneshov, Stockholm, Sweden, 121 71

[21] Appl. No.: 858,638

[22] Filed: Dec. 8, 1977

[30] Foreign Application Priority Data

Dec. 9, 1976 [SE] Sweden ..... 7613876
Apr. 15, 1977 [SE] Sweden ..... 7704362

[51] Int. Cl.[2] ..... F24F 7/00; F24F 13/00
[52] U.S. Cl. ..... 98/40 D
[58] Field of Search ..... 98/40 C, 40 E, 40 N, 98/56, 57, DIG. 10, 40 D

[56] References Cited

U.S. PATENT DOCUMENTS

| | | | |
|---|---|---|---|
| 1,319,267 | 10/1919 | Brown | 98/50 |
| 2,466,362 | 4/1949 | Blake et al. | 98/56 X |
| 2,651,250 | 9/1953 | Marquardt | 98/40 D |
| 2,929,154 | 3/1960 | Finnegan | 98/56 X |
| 3,057,286 | 10/1962 | Collins | 98/56 |
| 3,071,045 | 1/1963 | Budd | 98/56 X |
| 3,124,903 | 3/1964 | Truhan | 98/40 D X |
| 3,363,532 | 1/1968 | Hornoff | 98/40 D |
| 3,774,522 | 11/1973 | Marsh | 98/33 RR |
| 3,817,160 | 6/1974 | Searcy et al. | 98/40 C |
| 3,824,909 | 7/1974 | Horneff et al. | 98/40 D |
| 4,023,472 | 5/1977 | Grunder et al. | 98/40 D |

FOREIGN PATENT DOCUMENTS

| | | | |
|---|---|---|---|
| 1102371 | 3/1961 | Fed. Rep. of Germany | 98/40 N |
| 1956659 | 11/1968 | Fed. Rep. of Germany | 98/40 C |
| 2309390 | 8/1974 | Fed. Rep. of Germany . | |
| 325012 | 10/1957 | Switzerland . | |
| 536468 | 6/1973 | Switzerland . | |
| 10687 | of 1915 | United Kingdom . | |

OTHER PUBLICATIONS

Swedish Publication Verkstackrna, Dec. 1973, pp. 657–658.
Published Swedish Patent Application No. 73–12613–8.

*Primary Examiner*—Ronald Feldbaum
*Attorney, Agent, or Firm*—Fleit & Jacobson

[57] ABSTRACT

A screen for improving the environment of separate working areas in a working place having a plurality of such working areas, e.g. a factory floor, a workshop, an office or the like, is provided with a mechanism for connecting the screen to an air-supply line and exhibits at least one perforated side surface. The screen is hollow and accommodates a perforated supply and distributing pipe for fresh air. So as to evenly distribute the air, the pipe in a preferred embodiment has a number of nozzles which project into the path of the main-flow in the pipe and deflect uniform part flows therefrom in a direction substantially transversally of the direction of the main-flow and at substantially the same speed as the speed of the main-flow before the first nozzle. The screen may serve as a combined acoustic and air-supply screen which enables personnel to work close to the screen without being subjected to draughts.

12 Claims, 10 Drawing Figures

SCREEN FOR IMPROVING THE ENVIRONMENT OF A WORKPLACE HAVING A PLURALITY OF WORKING AREAS

BACKGROUND OF THE INVENTION

1. Field of Invention

In workshops having a multiplicity of working areas, e.g. a factory floor, a workshop floor or the like, and particularly in workshops in which the air is contaminated by work carried out in said work areas, for example welding operations, the treatment of dust-generating, fibrous or ill-smelling substances etc., it is necessary to introduce fresh air as close to the different working areas as possible, without mixing the fresh air with the contaminated workshop-air. The same holds true for warm working areas where cool air should be introduced. Those ventilation systems at present found in industrial workplaces are normally placed on a wall or the ceiling at a relatively long distance from the place where work is being carried out, which normally means that the fresh air is contaminated with the workshop air and/or heated before it reaches said working areas. This contamination of the air, together with the noise created, is one of the most serious features of a bad environment.

2. Description of Prior Art

Different types of air-supply systems for improving the ventilation of a working area for certain specific purposes are previously known to the art. The Swiss patent specification No. 536,468, the German published specification (DOS) No. 2,309,390 and U.S. Pat. Nos. 3,774,522 and 3,824,909 disclose examples of proposed arrangement for supplying to a "clean room" in a hospital or the like air which, for obvious reasons, is free from bacteria. The U.S. Pat. No. 3,824,909 and the Swiss patent specification No. 325,012 disclose two different arrangements for effectively supplying air to a working area via the ceiling thereof.

U.K. patent specification No. 10,687 describes supply of air to an audience room in a theatre via the backs of the seats in the room. The Published Swedish patent application No. 73 12613-8 describes an arrangement for supply of air combined with a heat emitting source. The Swedish Publication Verkstäderna, December 1973, page 657–658, describes supply of air to a factory floor into separate horizontal layers.

Previously there has also been proposed different types of screens for improving the environment in a workplace having a multiplicity of working areas, e.g. a factory floor, a workshop, open-plan offices or the like, at separate working areas. Such screens have as a rule a supporting or attaching means for fixed or movable placing or attachment on a floor, to a wall, a roof, another screen or the like.

The use of screens has been proposed for different purposes, for instance for absorbing sound generated in a working area, so that remaining parts of the workplace are screened from said working area or to screen and delimit different, adjacently lying working areas from each other and from noise created in said workplace.

SUMMARY OF THE INVENTION

The present invention is based on the view that such screens can be utilized more efficiently and more thoroughly for improving the working environment in different working areas.

The screen according to the invention is characterised in that the screen is provided with means of connecting said screen to an air-supply line, and exhibits at least one perforated side surface, through which air can be directly supplied to such a separate working area.

Conveniently the screens are removably connected to the air-supply duct by means of a flexible supply line.

Fresh air is supplied to said screens, which can but must not be movable, via said preferably flexible supply line which may have the form of a hose and may be connected to the upper edge of respective screens. This connection is preferably made readily removable, thereby to provide a high degree of flexibility with regard to the arrangement of the screens.

Each screen may be provided with a distributing pipe of perforated sheet metal arranged to distribute the air uniformly within the screened area. In this regard, when the screens are provided on at least one side with a large number of holes or perforations, there is obtained, in accordance with a preferred embodiment of the invention, further equalization of the air-flow, and the rate of air-flow in front of the screen is very low.

This effective distribution of the air, which has a laminar outflow from the screen, enables personnel to work close to the screen without being subjected to draughts.

Distribution of the flow supplied by the pipe in equal part-flows is facilitated if according to a preferred embodiment of the invention the supply pipe comprises a number of nozzles which project into the path of the flow of air and deflect a number of equal and uniformly distributed part-flows departing in a direction substantially transversally of the direction of the main-flow in said pipe.

Said nozzles are preferably so designed that the speed of the part-flows substantially corresponds to the speed of the main-flow prior to the first nozzle.

In this way, that part of the main-flow which strikes the inwardly projecting nozzle will be stopped in the direction of the main-flow and its dynamic pressure will be converted to a static pressure at the inlet of said nozzle. This means that—as, at the inlet of each nozzle, $P_{tot} = P_{stat} =$ constant—the flow through each nozzle will be equally great. It is assumed in this respect that losses due to friction can be ignored, which is normally possible.

According to a preferred embodiment, the nozzles are provided with inlets which extend obliquely relative to the direction of the main-flow and part-flows.

Nozzles having oblique inlets of the given type have been found in practice to afford extremely uniform distribution, a low pressure drop, low sound-generation, and the function of such a nozzle is substantially completely independent of the speed at which the main-flow moves.

A distribution pipe provided with such nozzles can be applied with many different types of air-supply means than air-supply screens for example air-curtains, air-locks, rapid-cooling devices, air-distributing means for attachment to ceilings, etc.

In practice, it is preferred that the nozzles are divided into parts or chambers via partition walls or flaps. These chambers are preferably so constructed that each of said chambers is through-passed by substantially equally large parts or part-flows.

To this end, the nozzles may be provided with partition walls having a smaller axial length than the greatest length of the nozzle.

In a particularly suitable embodiment, the nozzles are provided with three portions or chambers which are defined by partition walls which form together an angle of approximately 120°.

If a large number of nozzles are uniformly distributed along a tube around the periphery thereof uniform and reliable distribution of the flow within the screen is obtained. Thus, since the air streams which have a relatively high speed, are reflected against the walls, there is obtained a turbulent air flow within the screen. This provides a very uniform air flow through the whole of the perforated surface—normally one side—of the screen. Furthermore, the flow will be perpendicular to the perforated surface.

The magnitude of the part-flows can be regulated by regulating the magnitude of the main-flow. Thus, the air flow through respective nozzles need not be constricted, as is the case with previously known arrangments.

One important advantage obtained with the invention is that the main-flow may move at a high speed—10 m/sec. or more—without disturbing noise being generated in the nozzles.

In order for the air in a working area to be of high quality, the fresh air supplied to the working area should have a somewhat lower temperature than the room temperature, which causes a layering of the air. In this respect, heating of the workplace is suitably effected separately.

Screens provided with air-supply means of the type described can be connected together or arranged adjacent conventional acoustic screens, to form a complete system.

BRIEF DESCRIPTION OF THE DRAWINGS

So that the invention will be more readily understood and further features thereof made apparent, some exemplary embodiments of the invention will now be described with reference to the accompanying drawing, in which.

DESCRIPTION OF PREFERRED EMBODIMENTS

Figure 1:
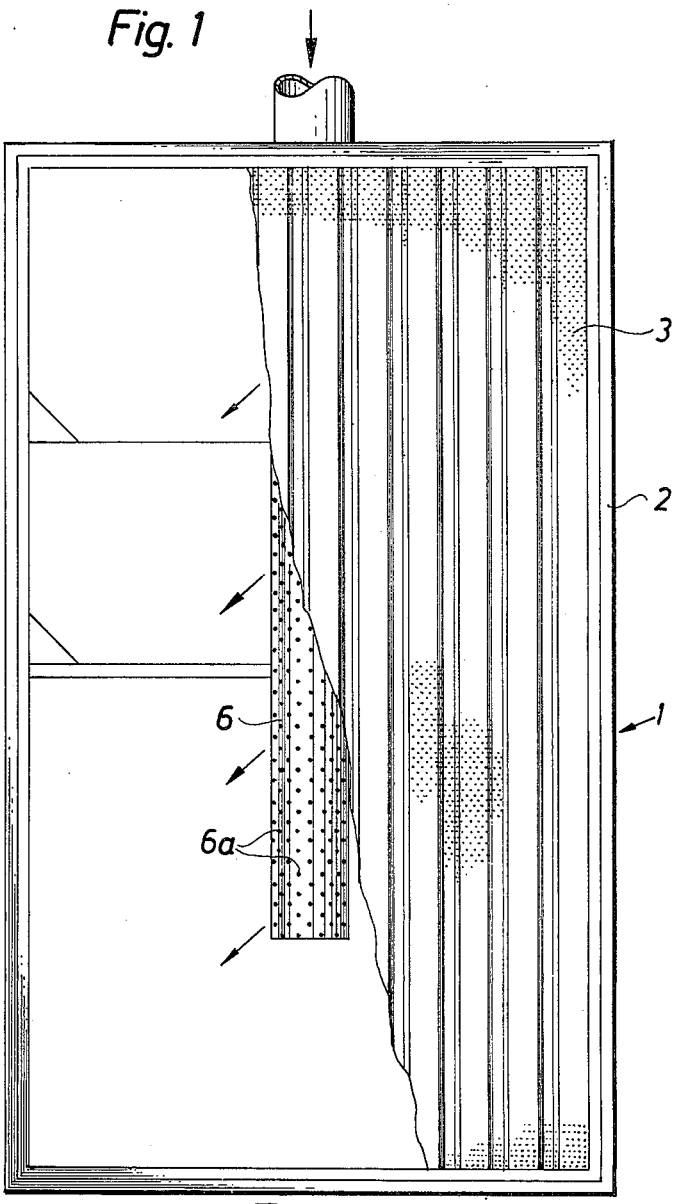
FIG. 1 is a partially cut-away side view of an air-supply screen constructed in accordance with the invention.
Figure 2:
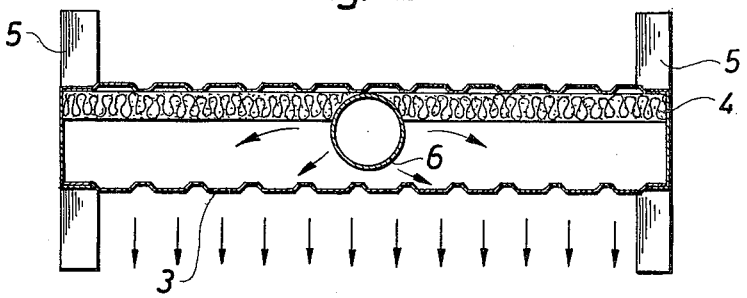
FIG. 2 is a partially cut-away plan view of the screen shown in FIG. 1.

Shown in FIGS. 1 and 2 is a screen 1 having a metal frame 2 which is, for example, 2 meters high and 1 meter wide and which is to be used to screen a working area on a factory floor or workshop floor. The side surfaces 3 of the screen comprise perforated sheet metal, which may be profiled. The screen is of hollow construction and has a sound-absorbing material 4 arranged therein, which affords to the screen good acoustic properties and prevents noise from speading to adjacent working areas. As will be understood, such an acoustic screen will assist in screening the working area in question from noise generated in the remainder of the shop floor.

The screen is movable and is provided with a plurality of feet 5.

The upper edge of the screen is connected to a pipe 6 by suitable means (not shown). Since the pipe 6 can be readily disconnected from the screen 1, there is obtained a high degree of flexibility, i.e. the screen can be moved when desired without creating serious problems. Arranged within the screen is a perforated, sheet-metal distribution pipe 6 which uniformly distributes the air supplied to the interior of the screen. When the air passes the outer, perforated plate the air flow is further equalized and the rate of flow in front of the screen is very low.

The screen may be provided with control means (not shown) for individual control of the amount of air supplied to a selected working area. Further, measuring means may be provided for readily controlling the amount of air supplied per unit of time. Means may also be provided for controlling and regulating the temperature of the air supplied to the screen. As before-mentioned, the temperature of the air supplied should be somewhat lower than the room temperature. In this way heating of the workshop floor can be effected separately.

Figure 3:
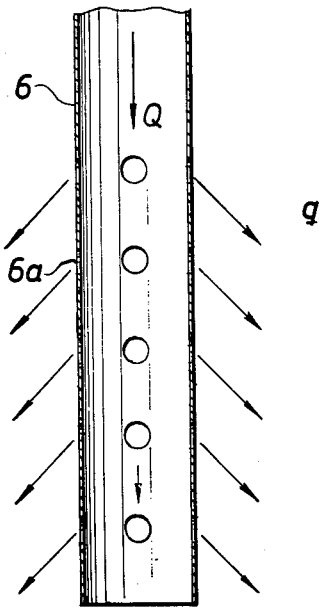
FIG. 3 is a side view of a somewhat modified pipe provided with a plurality of holes and intended for a screen according to FIG. 8.
Figure 4:
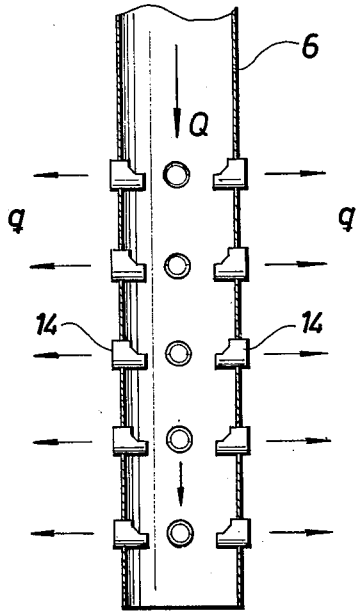
FIG. 4 illustrates the pipe shown in FIG. 3 provided with a number of nozzles.
Figure 5:
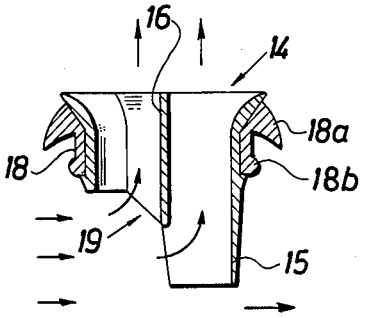
FIG. 5 is a cross-sectional view of a nozzle according to FIG. 4.
Figure 6:
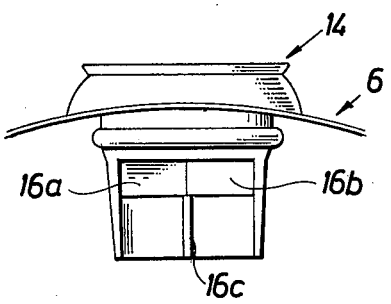
FIG. 6 is a side view of the nozzle shown in FIG. 5 mounted on a pipe shown in FIGS. 3 and 4.
Figure 7:
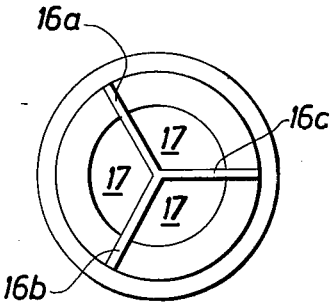
FIG. 7 is a plan view of the nozzle shown in FIGS. 5 and 6.

In FIG. 3 there is shown a modified pipe 6 intended to receive an air-flow Q, which shall be divided into a plurality of part-flows $\underline{q}$ through holes 6*a*. As shown in FIG. 4, to this end there is mounted in the holes 6*a* a plurality of nozzles 14. The nozzles are of the type illustrated in FIGS. 5 and 6, i.e. they project into the pipe and exhibit an oblique inlet, said nozzles causing the flow of medium through the pipe to slow down and part-flows $\underline{q}$ to be deflected from the main-flow.

Each nozzle has a number of partition walls 16, according to the example three partition walls 16*a*, 16*b*, 16*c* which form an angle of 120° with each other. The front partition walls 16*a*, 16*b* have a height or axial length struck by the airflow which is approximately one third of the height or length of the nozzle inlet projecting into the flow.

With a nozzle so constructed, one third of the part-flow $\underline{q}$ in question will pass each of the chambers 17 formed in the nozzle by the partition walls 16*a*, 16*b*, 16*c*.

In practice, it has been found suitable to divide the nozzles into three chambers 17, although it is also conceivable to use more or less chambers.

The nozzles 14 are mounted in the holes 6*a* in the pipe 6 by first inserting a holder ring 18 into each hole 6*a*. The holder ring exhibits projections 18*a*, 18*b* which engage the edges of the hole. The nozzle 14 is then pressed into the ring, the ring expanding to firmly hold the nozzle.

Figure 10:
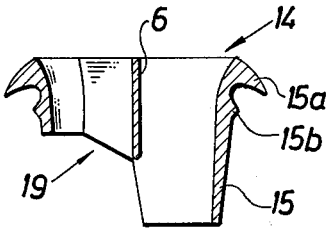
FIG. 10 is a cross-sectional view of a nozzle which is slightly modified in relation to the embodiment shown in FIG. 5.

FIG. 10 illustrates a modified embodiment of the nozzle 14, in which a holder ring is not used. Instead, the peripheral surface of the nozzle exhibits a rearwardly-extending projection 15*a* which co-acts with a hook-shaped rear lip 15*b*, which is formed integrally with the periphery of the nozzle.

Figure 8:
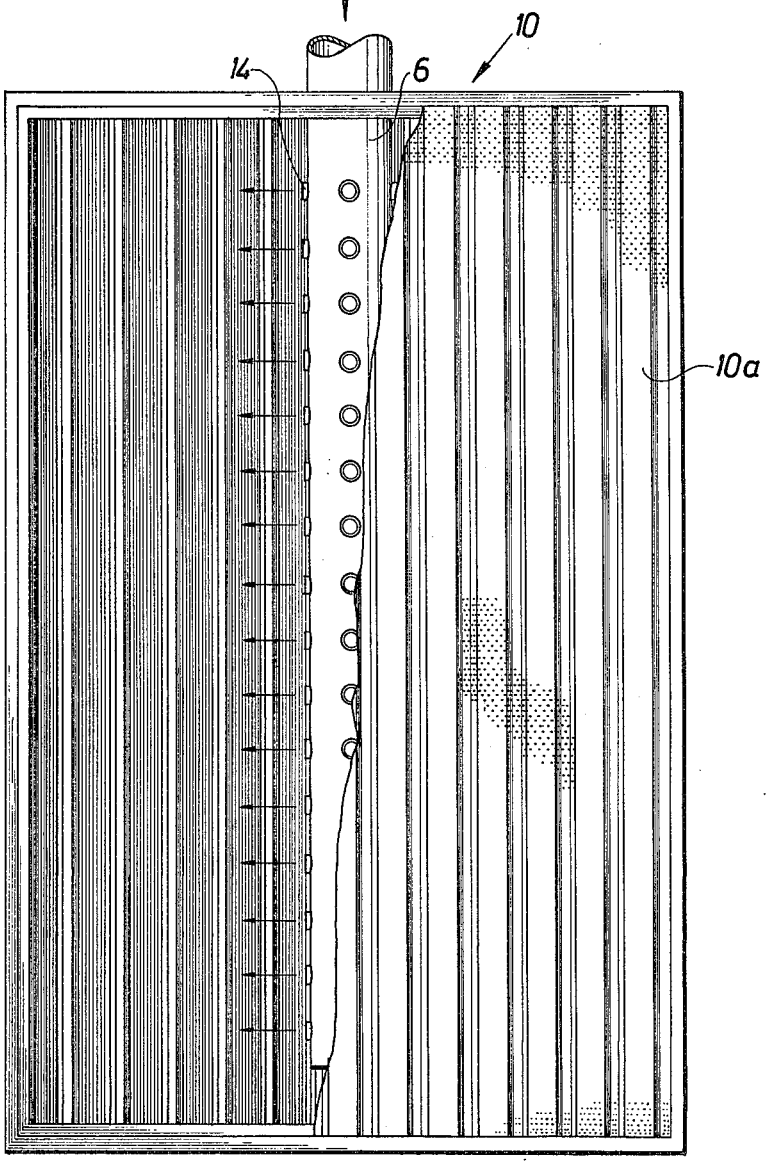
FIG. 8 is a partially cut-away side view of a relative to FIG. 1 modified compact air-screen having a perforated side surface and incorporating a distribution-pipe provided with nozzles in accordance with the invention.
Figure 9:
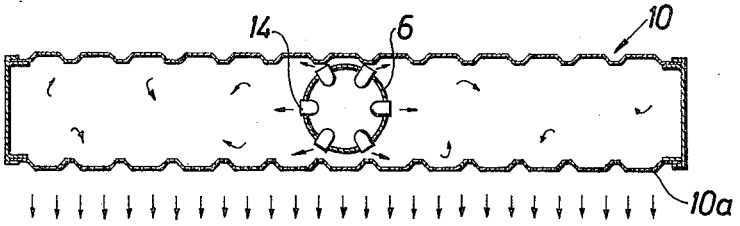
FIG. 9 is a plan view of the air-screen shown in FIG. 8.

FIG. 8 illustrates a distribution pipe 6 having a plurality of nozzles 14 incorporated in a compact air-screen 10 having a perforated side surface 10*a*. As will be seen from FIG. 9, the air-streams which in practice have a relatively high speed are reflected against the walls of the screen. In this way there is obtained a turbulent air-flow within the screen. This provides a uniformly distributed air-flow through the perforated side surface 10*a* of the screen. In addition, the flow is perpendicular to the perforated surface.

The magnitude of the part-flows is controlled by controlling the main-flow. Consequently, there is no need to constrict the air-flow in respective nozzles.

A particular advantage afforded by this arrangement is that the flow of medium is divided and distributed without disturbing noise being generated in the nozzles. This is also the case when the main-flow has a speed of, for example, 15 m/sec. or higher.

A distributing pipe of the aforedescribed type can also be used in conjunction with other air-supply devices than that illustrated.

Air-supply screens of the aforedescribed type can be used separately on a floor or a desk, secured to a wall or a roof or be placed adjacent to and optionally connected to similar screens or conventional acoustic screens to form a complete system. The screen may be provided with a perforated plate 3 and 10*a*, respectively, on both sides thereof, thereby to assist in defining two adjacent working areas whilst, at the same time, serving to supply fresh air to both said areas. In this case, the screen will not be provided with sound-absorbing material 4, FIG. 2, or such sound-absorbing material may be arranged centrally within the screen with the lateral surfaces of the screen devoid of such material.

When such a screen is used in an office or the like, in which different working areas to be screened from noise, such as the noise of a typewriter, the screen may have different dimensions so that it can be placed on a desk or the like for example.

I claim:

1. A screen having side surfaces for improving the environment of a workplace comprising:

frame means for defining a generally rectangular-shaped frame;

support means for detachably supporting said frame on a support surface;

a perforated sheet connected to said frame to define one side surface of said screen;

a second sheet spaced from said perforated sheet and connected to said frame to define the other side surface of said screen, said sheets cooperating to define an enclosed space within said screen;

connection means associated with a portion of said frame adapted for connecting said enclosed spaced with an air-supplying line; and said screen further comprising a perforated supply and distributing conduit for fresh air connected to said connection means and disposed within the enclosed space;

deflection means comprising the supply and distributing conduit for fresh air having a number of radially disposed nozzles which project into the path of the flow of air and deflecting a number of equal and uniformly distributed part-flows departing in a direction substantially transverally of the direction of the main-flow in said conduit.

2. A screen as claimed in claim 1, wherein the nozzles are designed in such manner that the speed of the part-flows substantially corresponds to the speed of the main-flow before the first nozzle.

3. A nozzle as claimed in claim 2 wherein, each nozzle has an inclined inlet and a means for mounting the nozzle in the supply and distributing pipe.

4. A screen according to claim 3, wherein said nozzles comprise internal partition walls having a shorter axial length than the greatest length of the nozzle, said partition walls dividing the nozzle into parts or chambers arranged to accommodate substantially equally large part-flows.

5. A screen according to claim 4, wherein each nozzle comprises three partition walls which form an angle of approximately 120° with each other.

6. A screen according to claim 5, wherein the nozzle height of the partition walls is approximately one third the length or height of the nozzle inlet projecting into the flow.

7. A screen according to claim 1, further comprising valve means for regulating the amount of air supplied to the screen.

8. A screen according to claim 1, wherein the second sheet is a perforated sheet.

9. A screen according to claim 1, further comprising sound absorbing material disposed in said enclosed space.

10. A screen according to claim 9, wherein the sound absorbing material is disposed adjacent the second sheet and substantially covers the second sheet.

11. A screen according to claim 9, wherein said support means are adapted to support said frame in a substantially horizontal position.

12. A screen according to claim 9, wherein said support means are adapted to support said frame in a substantially vertical position and are freely movable with respect to the support surface.

* * * * *